United States Patent [19]

Hunter

[11] 4,303,378

[45] Dec. 1, 1981

[54] CONCRETE PUMP

[75] Inventor: John Hunter, Torrance, Calif.

[73] Assignee: Thomsen Equipment Company, Gardena, Calif.

[21] Appl. No.: 51,689

[22] Filed: Jun. 25, 1979

Related U.S. Application Data

[63] Continuation of Ser. No. 835,514, Sep. 22, 1977, abandoned.

[51] Int. Cl.[3] ..... F04B 7/02

[52] U.S. Cl. ..... 417/517; 137/625.43

[58] Field of Search ..... 417/516–519, 417/900; 137/625.43

[56] References Cited

U.S. PATENT DOCUMENTS

| | | | |
|---|---|---|---|
| Re. 26,820 | 3/1970 | Bennett | 417/317 |
| 2,825,955 | 3/1958 | Ede | 417/900 |
| 3,194,271 | 7/1965 | Viessmann | 137/625.43 |
| 3,295,554 | 1/1967 | Huppert | 137/625.43 |
| 3,545,893 | 12/1970 | Schlecht | 417/517 |
| 3,628,897 | 12/1971 | Stetter | 417/900 |
| 3,703,910 | 11/1972 | Smith | 137/375 |
| 3,741,691 | 6/1973 | Schwing | 417/517 |
| 3,771,908 | 11/1973 | Rosen | 417/557 |
| 4,057,373 | 11/1977 | Schwing | 417/519 |
| 4,167,374 | 9/1979 | Smith | 417/900 |
| 4,191,513 | 3/1980 | Schwing | 417/900 |

FOREIGN PATENT DOCUMENTS

| | | | |
|---|---|---|---|
| 1024299 | 2/1958 | Fed. Rep. of Germany | 137/625.43 |
| 1280109 | 11/1961 | France | 137/625.43 |
| 538169 | 7/1941 | United Kingdom | 137/625.43 |

*Primary Examiner*—William L. Freeh

*Attorney, Agent, or Firm*—Edward J. DaRin

[57] ABSTRACT

A fluid operated pump for concrete and similar materials comprising a pair of piston-cylinder units connected to a concrete housing having a single valve for controlling the charging and discharging of the material. The valve control element and the concrete housing are defined in a mating relationship for minimizing flow restrictions of the material moved through the housing. Other efficiencies in the fluid circuit structures and arrangements are provided.

10 Claims, 9 Drawing Figures

CONCRETE PUMP

This is a continuation of application Ser. No. 835,514, filed Sept. 22, 1977, now abandoned.

PRIOR ART AND SUMMARY OF THE INVENTION

This invention relates to pumps and more particularly pumps adapted for conveying building materials such as plaster, concrete, mortar and similar moist compressible materials.

The pump which is the subject of the present invention is an improvement over the concrete pump disclosed and claimed in U.S. Pat. No. Re. 26,820 granted on Mar. 10, 1970. The aforementioned patent discloses the construction of a mobile concrete pump that has been widely accepted throughout the United States and in most of the commercially important foreign countries. The concrete pump disclosed in U.S. Pat. No. Re. 26,820 is a pump which is a hydraulically operated pump of the piston-cylinder class. The concrete pump includes a material or concrete chamber having a single control valve element for controlling the charging and discharging of the material in the material chamber. The material chamber is provided for housing a single control element or what is commonly known as a flapper element. The flapper element may be a simple plate that performs the desired function of controlling the material undergoing pumping for purposes of charging and discharging the material. The conveyance of material such as concrete through the material chamber is an important consideration in the construction of a concrete pump.

The present invention provides an improved pump for conveying building materials such as plaster, concrete, mortar and the like and is an improvement over the specific types of pumps described and claimed in U.S. Pat. No. Re. 26,820. The material or concrete chamber and single control or flapper element, in accordance with the present invention, is constructed and defined whereby the flapper element or single valve control element is contoured along with shaping the material chamber in a mating relationship for minimizing any flow restriction of the material conveyed through the chamber. In particular, the single control element or the flapper is constructed and defined from one-piece of material permitting the element to be machined and thereby closely control the concentricities thereof.

The housing of the control element is constructed and defined with a large, removable cover permitting the flapper element to be readily removed for servicing and the like. In addition, the large cover opening allows the interior of the housing for mounting the valve element to be readily machined and thereby greatly simplifies the installation of the wear plates for the flapper element. More efficiency in the operation of the concrete pump has been realized by locating the tank storing the lubrication medium or water for the pumping units so that it is directly connected to the material or concrete cylinders thereof thereby eliminating the need for any additional power source for conveying the water to the point of use, such as when the lubricating medium or water is located at a remote location from the pumping units. In addition, the relocation of the point of application of the driving hydraulic fluid for the piston-cylinder pumping units increases the overall efficiency of the hydraulic system and eliminates the need for certain hydraulic seals required in the prior art hydraulic systems.

From a structural standpoint, the invention comprehends an application for pumping moist compressible materials such as plaster, concrete, mortar and the like wherein two pumping units are provided. The pumping units are arranged within an enclosed material housing having a material inlet means and material outlet means arranged on opposite sides of the cylindrical material chamber defined therein. The pump includes means for charging the material to be pumped into the material chamber. The material chamber includes apertures for placing each of the pumping units in direct communication with the material chamber. A single plate-like control member is swingably or rotatably mounted in the material chamber to subdivide the chamber for alternatively allowing the individual subdivided portions to function with the pumping units as a means to charge and discharge material. The control member is further characterized as a plate-like element having aligned trunnions extending outwardly therefrom for rotatably mounting the control element in the material chamber and being constructed and defined from one-piece of material. The lateral faces of the element is constructed and defined with concave surfaces for mating with the adjacent surface of the cylindrical material chamber for defining conduit-like passages for reducing the flow restriction of the material conveyed through the chamber.

The pumping units may be in the form of piston-cylinder units wherein the material cylinders are in direct communication with the material chamber and a closed volume is defined behind the reciprocating piston heads. A lubricating fluid storage tank is mounted between the pumping units so as to be coupled directly in communication with the closed ends of each material cylinder for permitting the lubricating medium to flow in and out of the closed volume behind the piston heads in accordance with their positions without resorting to any additional power source.

These and other features of the present invention may be more fully appreciated when considered in the light of the following specification and drawings, in which.

Figure 1:
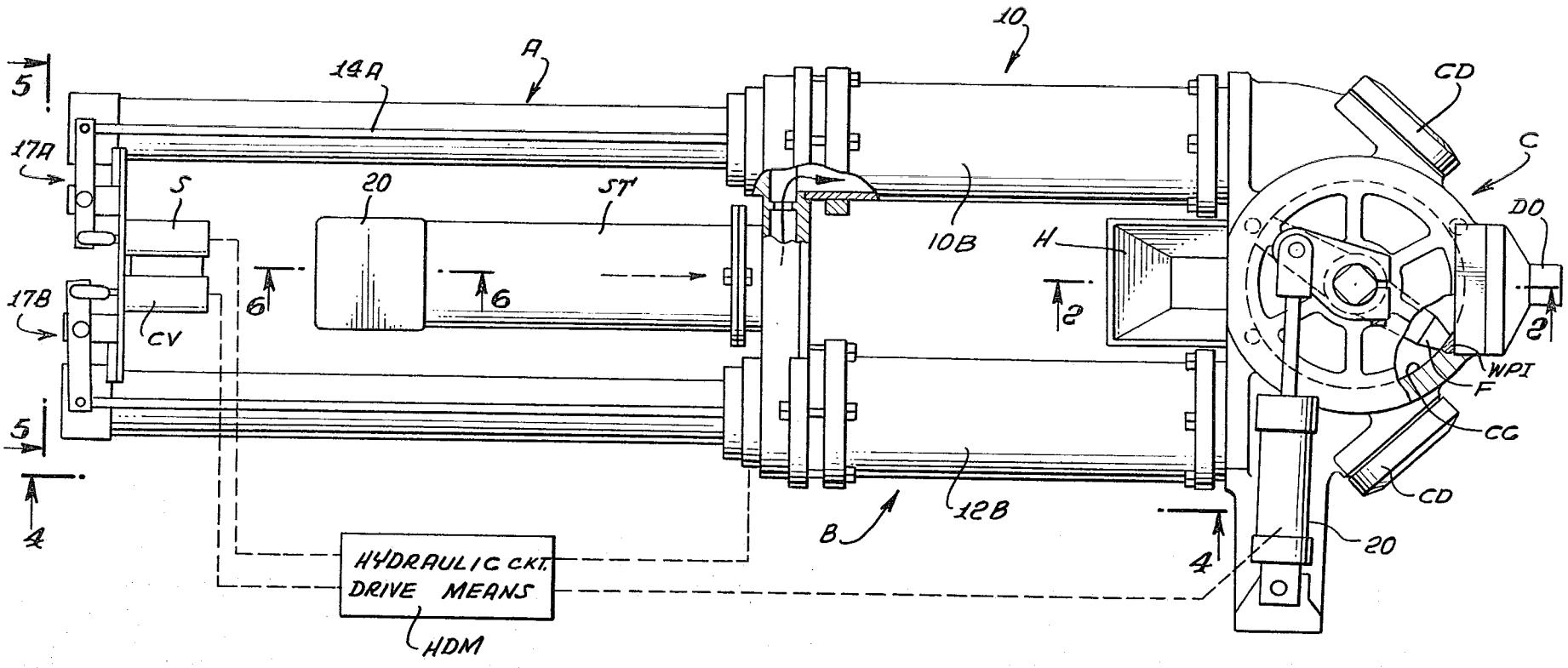
FIG. 1 is a top plan view with a portion shown in section, of the pump assembly embodying the present invention.
Figure 4A:
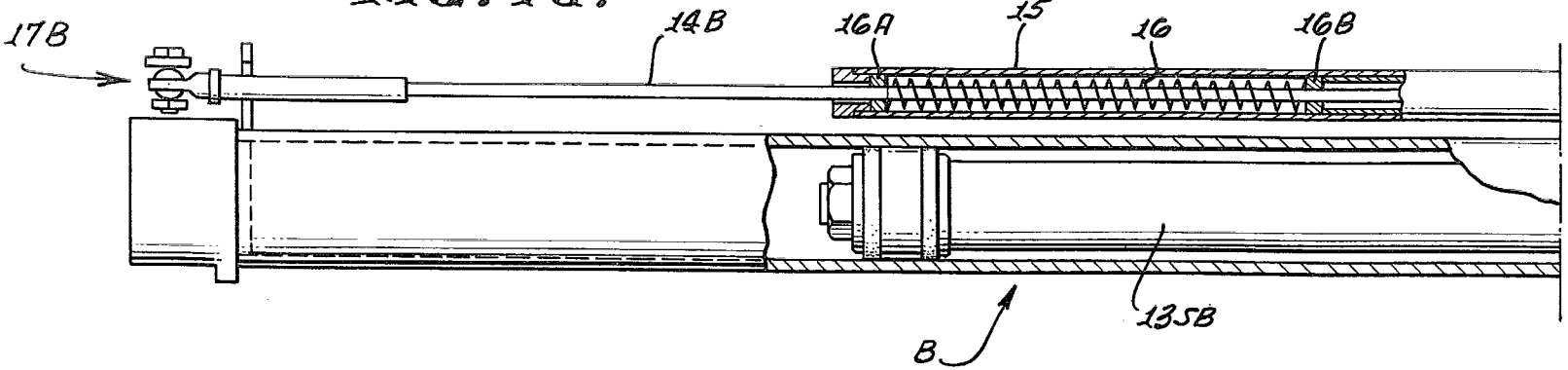
Figure 4B:
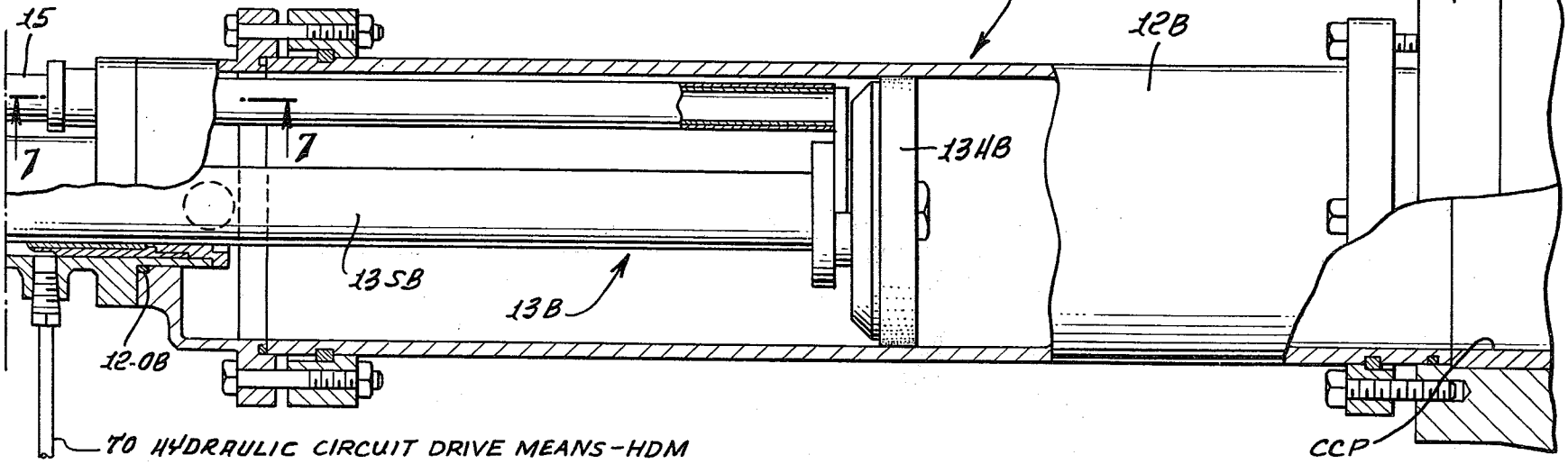
Figure 5:
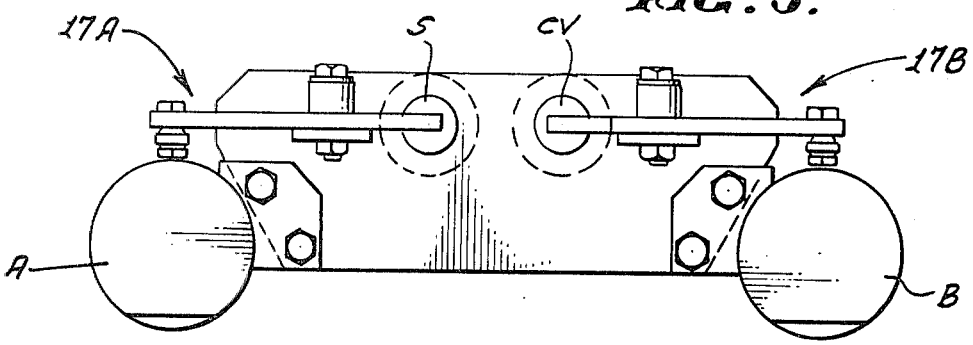
Figure 6:
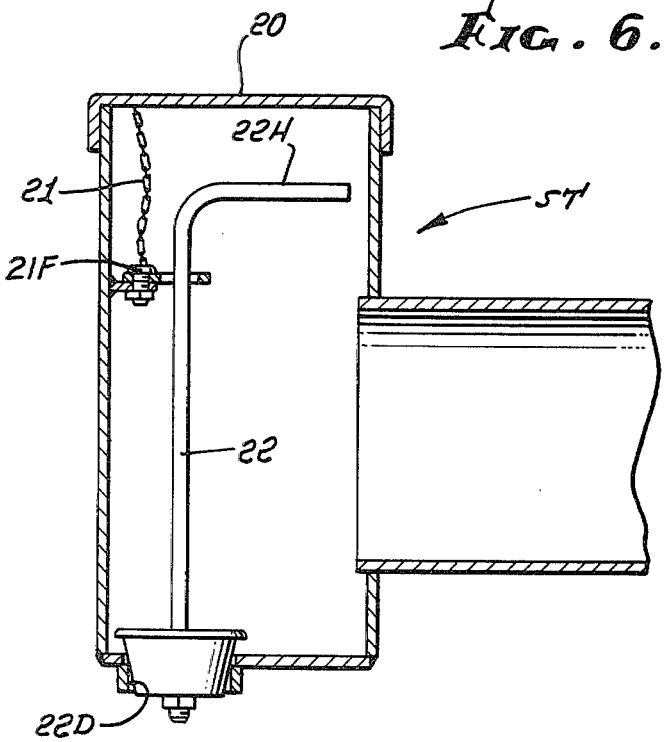
Figure 7:
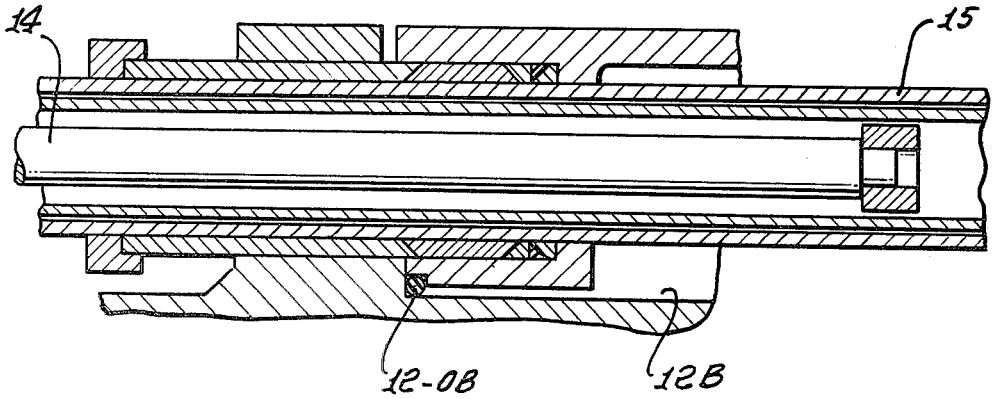
Figure 8:
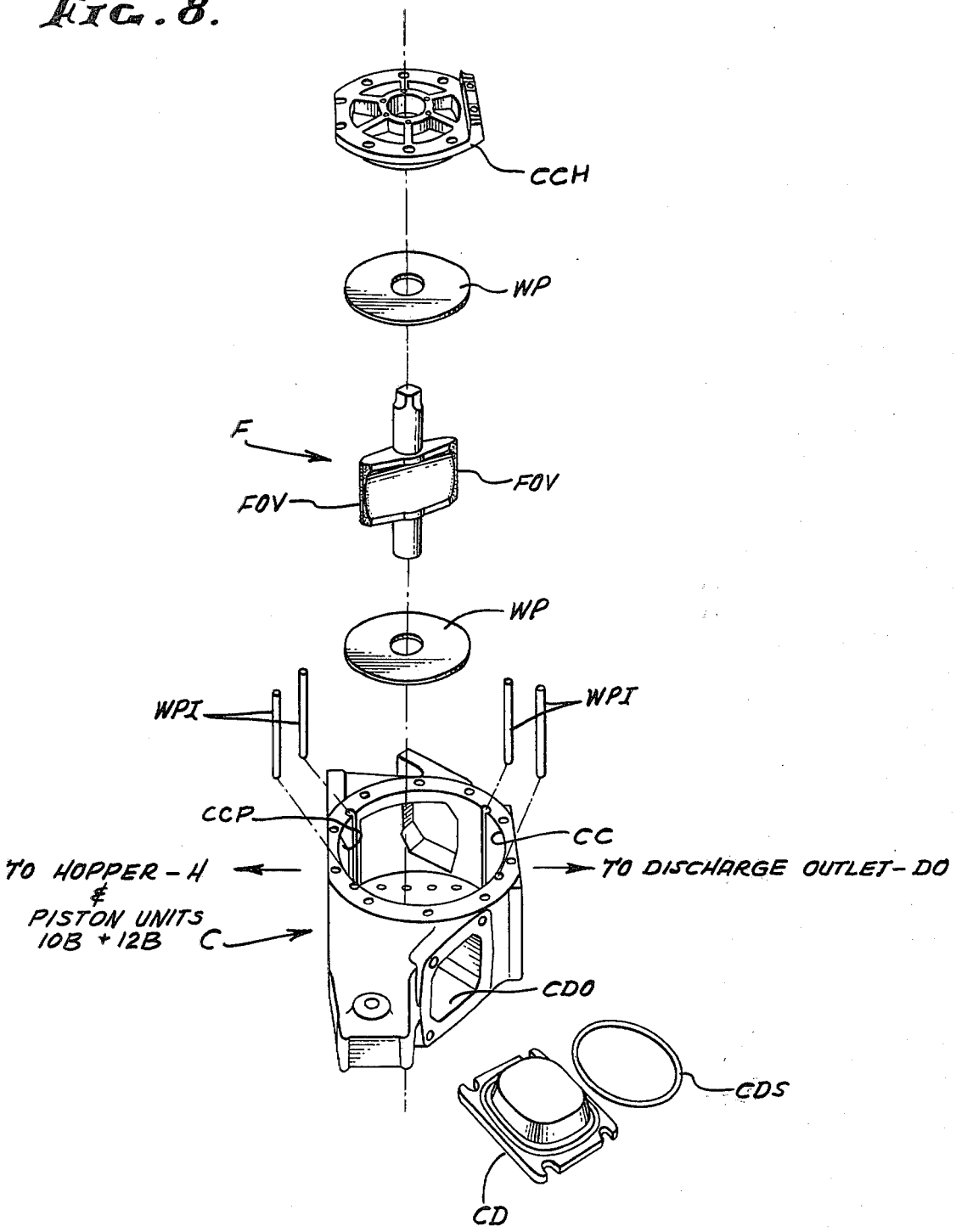

FIGS. 4A and 4B when aligned as indicated are a cross-sectional view through an entire pumping unit taken along the line 4—4 of FIG. 1;

FIG. 5 is a rear elevational view of the control valves mounted on the pumping units and taken in the direction of line 5—5 of FIG. 1;

FIG. 6 is a partial, sectional view taken along the line 6—6 of FIG. 1;

FIG. 7 is a partial, sectional view taken along the line 7—7 of FIG. 4B, and FIG. 8 is an exploded view of the principal elements of the material housing illustrated in FIG. 1.

The pump of the present invention is particularly adapted for pumping moist, compressible materials such as building materials, plaster, concrete, mortar, and the like. The pump will be described in conjunction with the pumping of concrete.

The concrete pump may be mounted to the rear of the cab of a motor vehicle or truck. In such an application the power unit for the motor vehicle is employed as the primary power source for the concrete pump and is therefore provided with a drive member coupled between the power unit for the motor vehicle and the concrete pump. The power unit may be any other type of convenient unit when the pump is not mounted on a motor vehicle, such as an electric motor, for example.

The concrete pump generally comprises a pair of pumping units which are mounted on opposite sides of a material or concrete hopper. The hopper, as is conventional, is utilized to receive and store the material or concrete to be pumped and supplied thereto.

The pumping units are connected with a common material or concrete chamber for the pumps and are arranged in communication therewith and with the hopper to allow the pumping units to be directly charged with the concrete to be pumped from the hopper and to be discharged from the pumping units in response to their pumping strokes through a common outlet for the concrete chamber. A conduit is normally coupled to the outlet for conveying the concrete to the point of utilization of the concrete. The concrete chamber is provided with a single control valve that is adapted to assume two positions and thereby subdivide the chamber into two portions for allowing the alternate charging and discharging of the concrete to occur substantially simultaneously in each portion of the chamber.

The two positions of the single control valve are effective for substantially closing off one of the pumping units from the hopper while allowing the same pumping unit to discharge concrete through the outlet. During this same interval, the other pumping unit is substantially closed off from the discharge outlet while being in communication with the hopper through the hopper port. The charging of a pumping unit results due to the drawing in of the concrete from the hopper as a result of the suction created by the pumping unit to be charged being retracted from its completed pumping stroke. The control valve is positioned by a fluid pressure motor in a position to allow the pumping unit to discharge concrete through the discharge outlet while the other pumping unit is drawing concrete from the hopper.

The pumping units are constructed in the form of fluid pressure pumping units and preferably are hydraulically operated piston-cylinder units whereby the units are charged during their return strokes. The pumping units are controlled by a fluid power control circuit, preferably a hydraulic circuit, adapted to control the alternate charging and discharging of the concrete into and out of the pumping units while controlling the position of the control valve.

The above structure and operation is a brief summary of the concrete pump which is disclosed and claimed in the aforementioned U.S. Pat. No. Re. 26,820 and included herein as a basis for simplifying the explanation of the present invention. A more complete description of the construction of the mobile concrete pump may be found in said U.S. Pat. No. Re. 26,820, if required and such disclosure is incorporated herein by reference.

Now specifically referring to the drawing, the general organization of the concrete pump 10 will be examined in detail. The pump 10 generally comprises a pair of pumping units A and B arranged with a concrete chamber housing C having a single valve control element or flapper element F rotatably mounted within the cylindrical concrete chamber CC. The concrete to be pumped is charged into the concrete chamber CC by means of the hopper H arranged in communication therewith. The sequencing of the pumping units A and B is controlled by means of the hydraulic drive means HDM. The hydraulic drive means HDM functions with a pair of mechanically actuated valves shown as the cycle valve CV and the sequence make-up valve S. A storage tank ST for storing a lubricating or cooling medium, such as water, for the pumping units A and B is mounted between the units A and B as illustrated in FIG. 1.

The pumping units A and B are arranged in a parallel relationship with the concrete chamber housing C. The pumping units A and B each comprise reciprocating piston-cylinder assemblies controlled so that their forward or power strokes are utilized for pumping concrete through the housing C and their return, or suction strokes, are utilized to charge concrete into the pumping units. The pumping units A and B are both identically constructed and for the purposes of understanding the present invention only one of the units need be examined in detail. To this end, the pumping unit B is shown in detail in FIGS. 4A and 4B. When the structure of FIG. 4A is aligned with the structure of FIG. 4B, the complete assembly of the pumping unit B will be appreciated. The pumping unit B comprises a material or concrete cylinder 12B having a reciprocating piston unit 13B mounted therein. The piston unit 13B comprises a piston head 13HB mounted at the end of the shaft 13SB. The concrete cylinder 12B is closed at one end, the left-hand end as illustrated in FIG. 4B, and sealed by means of an "O" ring 12-OB for enclosing the cylinder. The shaft 13SB is arranged to reciprocate through the closed end of the cylinder 12B. The remaining end of the material or concrete cylinder 12B is arranged in direct communication with the concrete aperture CCP of the concrete chamber housing C in order to receive the concrete to be pumped in the cylinder 12B. The piston head 13BH is hydraulically controlled to reciprocate in a sliding relationship with the concrete cylinder 12B for drawing in the concrete to be pumped from the hopper H through the concrete chamber housing C and then pumping it through the concrete chamber CC through a discharge outlet DO. When the piston head 13HB is being retracted during the suction stroke from the right-hand position towards the left end, or closed end, of the cylinder 12B, the concrete is drawn into the concrete cylinder 12B behind the piston head 13HB. During the pumping strokes of the piston head 13H it travels from its left-hand extremity, as illustrated in FIG. 4B to the right for pumping the concrete previously drawn into the cylinder 12B back through the concrete chamber CC and out a discharge outlet.

From the above description, it should be appreciated that there is a closed volume defined behind the piston head 13HB when it is spaced from the closed end of the cylinder 12B. The closed volume is employed for receiving a lubricating and/or cooling medium behind the piston head 13HB as it reciprocates within the cylinder 12B, as will be explained more fully hereinafter. A push-/pull rod assembly 14B is coupled to the piston head 13HB and is carried by the piston head. The rod assembly 14B is mounted outside of the pumping unit proper and as illustrated in FIGS. 4A and 4B is mounted on the top of the pumping units A and B. The specific coupling of the push/pull rod assemblies 14A and 14B to the piston heads 13HA and 13HB is best appreciated from examining FIG. 4B. A push-pull rod 14B is mounted in a rod guide tube 15 secured adjacent the left-hand end of the concrete cylinder 12B as best appreciated from examining FIG. 7. The sleeve 15 mounts an override spring 16 seated between a pair of spaced bushings 16B and surrounding the sleeve enclosed portion of the push/pull rod 14B; see FIG. 4*a*. The remaining end of the push/pull rod 14B is connected to a linkage assembly generally identified by the reference numeral 17B for operating one of the control valves associated with the hydraulic drive means HDM. The push/pull rod 14B for the pumping unit 14 is specifically coupled to operate a cycle valve CV. The push/pull rod 14A for the pumping unit is similarly coupled to a linkage 17A for operating a sequencing make-up oil valve S. The hydrualic drive means for the pumping units A and B is diagrammatically represented by a box HDM in FIG. 1 and is generally of the same construction as that disclosed in the aforementioned U.S. Pat. No. Re. 26,820. The hydraulic pressure provided by the drive means HDM is alternately applied to the two pumping units A and B so as to alternately power the corresponding piston heads 13HA and 13HB. The hydraulic pressure is also alternatively applied to the opposite ends of a hydraulic cylinder 20 mounted over the concrete chamber housing C for controlling the position of the single control element, or flapper element F, in accordance with the alternate pumping strokes of the pumping units A and B. The hydraulic drive means HDM alternately pressurizes the pumping units A and B to cause one of the piston heads 13HA or 13HB to move forward on a pumping or concrete discharge stroke, while the closed loop arrangement of the hydraulic circuit will cause the other pumping or piston head to move in the return or suction stroke for charging the pumping unit with concrete from the hopper H. The cycle of operation is controlled by the two push/pull rods 14A and 14B mounted with the pumping units A and B for operating the cycle valve CV and the sequence make-up and valve S. The cycle valve CV when operated is effective for changing the position of the flapper element F and the valving (not shown) for reversing the direction of the pumping units A and B. The push/pull rod 14A for the pumping unit A actuates the valve S for automatically maintaining a constant volume of oil in the closed hydraulic circuit so as to assure a full stroke of the pistons 13HA and 13HB. This general type of operation is disclosed in the aforementioned U.S. Pat. No. Re. 26,820.

The efficiency of the hydraulic circuit HDM is increased over prior art hydraulic circuits such as disclosed in U.S. Pat. No. Re. 26,820 by coupling the hydraulic fluid to act against the head side of the hydraulic pistons; see FIG. 4B. In the hydraulic circuit disclosed in U.S. Pat. No. Re. 26,820 the hydraulic pressure is developed to act on the rod side of the hydraulic piston, see FIG. 3 of U.S. Pat. No. Re. 26,820, for example. The circuit arrangement in accordance with the present invention results in more efficient operation since there are less hydraulic line losses. In addition, certain costs are eliminated by operating with a very low hydraulic pressure on the rod side of the piston, namely, the elimination of the requirement for a high pressure seal between the hydraulic cylinder and the concrete cylinder; note col. 8, lines 57–71 of said U.S. Pat. No. Re. 26,820.

The water tank ST in accordance with the present invention is mounted between the parallel arrangement of the pumping units A and B with the concrete cylinders 12A and 12B. The water tank ST is specifically illustrated in FIGS. 1 and 6 of the drawings. The water tank ST is of a substantially L-shaped configuration and is arranged to be in direct communication with the left-hand end of the concrete cylinders 12A and 12B, as best appreciated from examining FIG. 1. The upstanding section of the L-shaped tank ST is provided with a cover 20. The cover 20 is secured to the tank by means of a chain 21 fastened between the cover and a fastener 21F, as best appreciated from examining FIG. 6. The tank includes means for draining the lubricating medium or water from the tank. The means for draining the tank ST, as illustrated in FIG. 6, is a manually operated stopper 22 mounting a drain aperture 22D provided in the bottom wall of the upstanding portions of the tank ST. The stopper 22 includes a handle 22H of an L-shaped configuration that is accessible through the tank opening when the cover 20 is removed to readily allow the water in the tank to be drained through the aperture 22D. It is necessary to have clear water in the cylinders to prevent damage to the pistons 13HA and 13HB.

Important features of the present invention are the constructions of the concrete housing C and its coacting single control element or flapper element F. The concrete housing C is internally constructed and defined to mate with the configuration of the flapper element F so as to minimize any tendency for flow restriction of the material passing through the chamber CC. The construction of the concrete chamber CC and the flapper element F is best appreciated from examining FIGS. 2, 3 and 8. The concrete housing C has a concrete chamber CC defined therein which houses the flapper element F. The flapper element F is constructed of one piece of material with coaxial trunnions FT arranged on opposite sides of the rectangular plate-like element functioning as a flapper element. The lower trunnion FT is rotatably mounted in the concrete housing C so as to mount the flapper or rectangular portion of the element F adjacent the bottom wall of the concrete chamber CC. The upper trunnion FT is similarly mounted.

The configuration of the element F for the above-mentioned purposes is produced by the contouring of the lateral faces of the rectangular plate-like element functioning as the flapper element F. Within a preselected area of the faces of the flapper element F a concavity is defined for mating with the cylindrical wall surfaces of the concrete chamber CC within the housing C. As best appreciated from examining FIG. 3, the concave portion of the flapper element is in the form of a shallow C configuration. The contoured face of the flapper element F, when arranged with the adjacent surface of the cylindrical concrete chamber forms a conduit-like opening through the concrete housing for minimizing any tendency for restricting the material or concrete flow through the chamber CC. Since the flapper element F is constructed of one piece of material, it is easier to machine and thereby the concentricities can be more easily controlled than when several pieces have to be machined and assembled.

Figure 2:
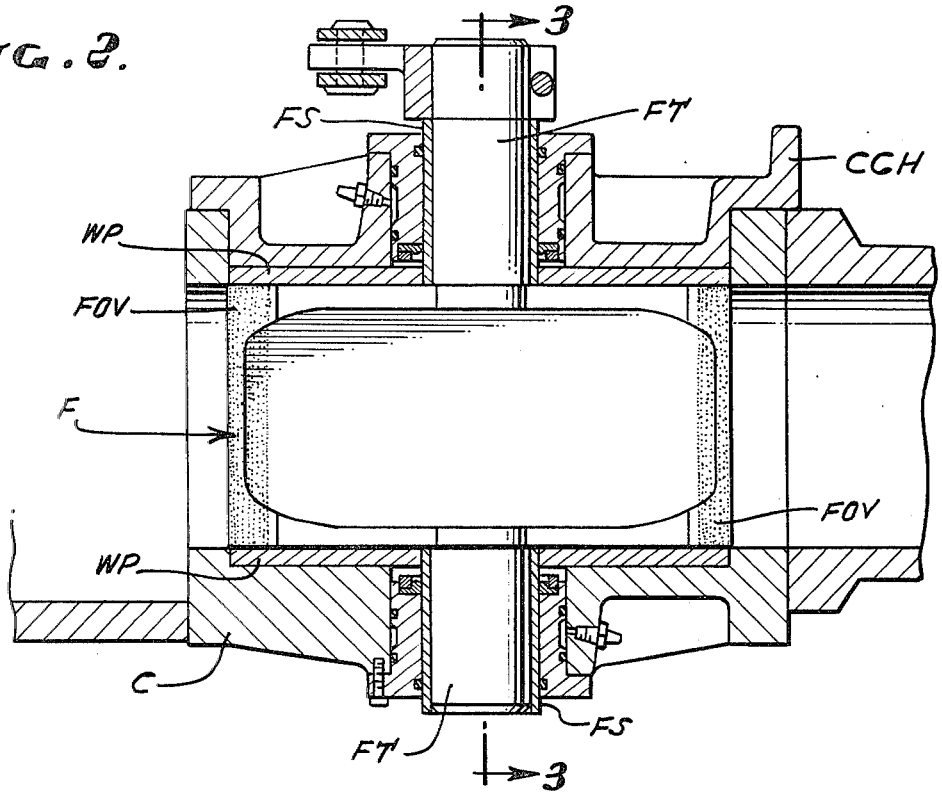
FIG. 2 is a cross-sectional view of the material chamber taken along the line 2—2 of FIG. 1.

It should also be noted that the flapper element F is provided with corrosive resistant sleeves secured by welding to the trunnions FT. The sleeves are identified in FIGS. 2 and 3 as sleeves FS illustrated in their assembled relationship with the concrete chamber C. The sleeves FS are preferably constructed of a chrome-plated material for corrosion purposes. In addition, the outer ends of the flapper element F are tapered and provided with a hard facing overlay for the complete lateral extent thereof for providing shearing edges for the flapper element. The hard facing overlay is illustrated in FIG. 2 and is identified as the portion FOV on the opposite ends of the flapper element F.

Figure 3:
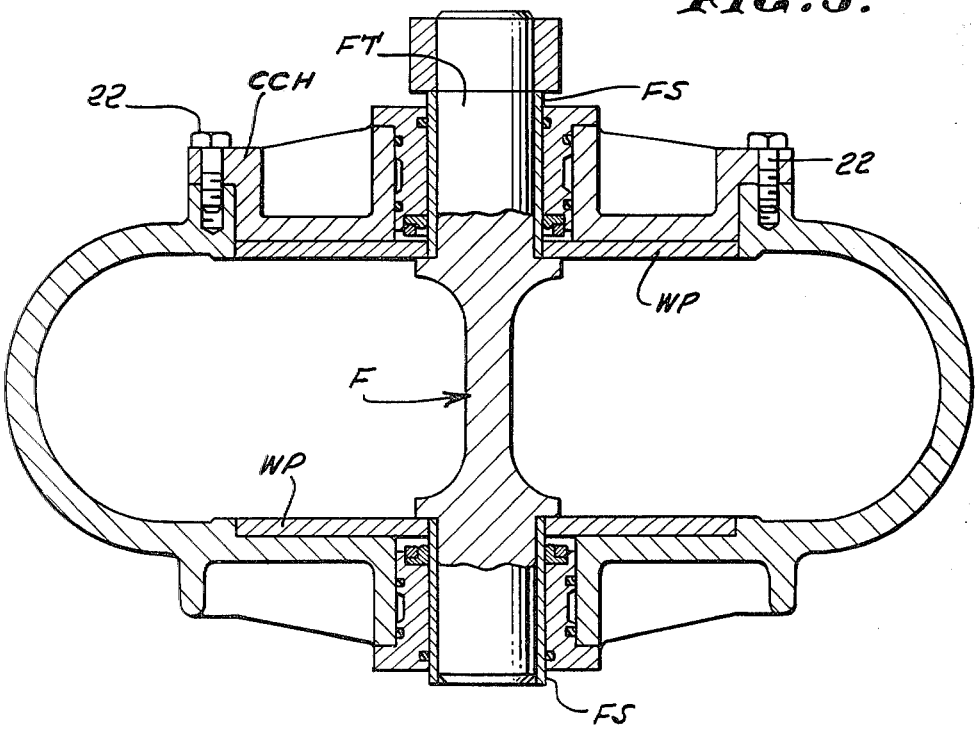
FIG. 3 is a cross-sectional view through the material chamber taken along the line 3—3 of FIG. 2.

The flapper element F and the concrete chamber housing C are also provided with wear means for minimizing the wear on the flapper element F and the housing C per se. The wear means comprises wear plates WP in the form of discs, one of which is mounted on the bottom surface of the cylindrical concrete chamber CC within the housing C. A similar wear plate WP is mounted to the top side of the cylindrical chamber as shown in FIGS. 2 and 3. The concrete housing C is provided with a large cover CCH that is secured to the top thereof by fasteners and is therefore readily removable. As illustrated in FIG. 3, the cover CCH is secured in position by means of fasteners 22. The large opening provided upon the removal of the cover CC permits the interior of the housing C to be readily machined for providing a smooth surface. As a result, the accuracy with which the interior surfaces of the housing C can be defined is closely controlled. This permits the wear plate WP to be easily mounted and assembled in the desired relationship on the bottom surface of the concrete cylinder CC. On prior art structures, machining was so difficult to accomplish that the wear plates were mounted on uneven cast surfaces and had to be shimmed to provide even surfaces. The shimming was by means of a putty-like material which required a high degree of skill to accomplish. The remaining wear plate WP is advantageously secured to the inside surface of the cover CC; see FIGS. 2 and 3. A portion of the upper trunnion FT extends out of the cover CC to allow it to be coupled to the control valve 20 for rotating the flapper element F between its two positions. The control element 20 is best illustrated in FIG. 1 mounted to the top surface of the concrete chamber and is readily accessible. The concrete chamber CC is also provided with a plurality of wear pins WPI secured in the housing C at the four joints that the edges of the flapper element F move into sliding engagement therewith; see FIG. 1, for example.

For the purposes of cleaning out the housing C, a pair of doors CD, one of which is illustrated in FIG. 8, permit access to the interior of the housing C on opposite sides of the flapper element F. The door CD is secured to the door opening CDO by means of a seal CDS. This allows any residual concrete left in the housing C after completion of the pumping operation to be readily cleaned out from both sides of the flapper element F. With the removal of the doors CD, a tool may be inserted into the openings CDO to scrape out the concrete residue.

What is claimed is:

1. An apparatus for pumping moist compressible materials such as plaster, concrete, mortar and the like including first and second pumping units, an enclosed material housing having a preselected outer configuration and a substantially cylindrical material chamber constructed and defined internally thereof, said housing including material inlet means and material discharge means communicating with the material chamber, means for charging the material chamber with the material to be pumped through the material inlet means, said material chamber inlet means including means for placing each of the pumping units in communication with the material chamber, a material valve element rotatably mounted within the material chamber and extending into sliding engagement with the chamber wall for controlling the flow of material at the inlet means and the discharge means so as to subdivide the chamber for alternately allowing the subdivided portions to function with the pumping units as a means to charge the material therein and to discharge the material therefrom, the valve element being arranged in the chamber relative to the inlet means and the discharge means so as to isolate the portion of the chamber discharging material from communication with the charging means but in communication with said chamber material discharge means, said material housing having a removable cover for exposing the valve element, said valve element being removable from the housing when the cover is removed to expose the valve element, the material housing further including wear means comprising a wear plate secured to the side of the housing opposite to the cover and a wear plate secured to the chamber side of the cover for the valve element to rotate on, the valve element being further characterized as a blade element having aligned trunnions and rotatably mounted thereby and within the blade element having oppositely contoured concave faces for mating with the opposed arcuate walls of the cylindrical chamber for defining conduit-like opening through the material chamber to minimize any tendency for the moist compressible material to be restricted in its flow through the material chamber when being conveyed through the chamber to the material discharge means, said aligned trunnions extend outwardly from opposite longitudinal edges of said blade element and each said trunnion being arranged substantially centrally of the longitudinal edges of said blade element and coaxial with one another so as to be constructed and defined as one piece with the blade element of the valve element, said contoured faces of the blade element being further characterized as having concavities of a preselected depth defined within the preselected perimeter of the blade element spaced inwardly of the edges of the lateral faces of the blade element to have a shallow "C" cross-section, and automatic means for operating said pumping units and for changing the position of said valve element in a preselected timed relationship.

2. In apparatus as defined in claim 1 wherein the wear means comprises wear pins secured in the cylindrical chamber at the four points the valve element slidably engages the chamber wall.

3. In apparatus as defined in claim 1 including a lubricating fluid storage means for the pumping units for direct coupling with the pumping units.

4. An apparatus for pumping moist compressible materials such as plaster, concrete, mortar and the like including first and second pumping units, an enclosed material housing having a preselected outer configuration and a substantially cylindrical material chamber constructed and defined internally thereof, said housing including material inlet means and material discharge means communicating with the material chamber, means for charging the material chamber with the material to be pumped through the material inlet means, said material chamber inlet means including means for placing each of the pumping units in communication with the material chamber, a material valve element rotatably mounted within the material chamber and extending into sliding engagement with the chamber wall for controlling the flow of material at the inlet means and the discharge means so as to subdivide the chamber for alternately allowing the subdivided portions to function with the pumping units as a means to charge the material therein and to discharge the material therefrom, the valve element being arranged in the chamber relative to the inlet means and the discharge means so as to isolate the portion of the chamber discharging material from communication with the charging means but in communication with said chamber material discharge means, the valve element being further characterized as a blade element having aligned trunnions and rotatably mounted thereby and within the blade element having oppositely contoured concave faces for mating with the opposed arcuate walls of the cylindrical chamber for defining conduit-like opening through the material chamber to minimize any tendency for the moist compressible material to be restricted in its flow through the material chamber when being conveyed through the chamber to the material discharge means, said aligned trunnions extend outwardly from opposite longitudinal edges of said blade element and each said trunnion being arranged substantially centrally of the longitudinal edges of said blade element and coaxial with one another so as to be constructed and defined as one piece with the blade element of the valve element, said contoured faces of the blade element being further characterized as having concavities of a preselected depth defined within the preselected perimeter of the blade element spaced inwardly of the edges of the lateral faces of the blade element to have a shallow "C" cross-section, automatic means for operating said pumping units and for changing the position of said valve element in a preselected timed relationship, said pumping units being hydraulically operated and controlled pumping units and include hydraulic drive means for alternately placing them in a pumping stroke and a return stroke, said pumping units comprise piston-cylinder units wherein the pistons are reciprocal between a pumping stroke and a return stroke in response to the hydraulic drive means, and push-pull rod means mounted on the outside of each pumping unit and coupled to an individual piston to be reciprocated thereby, the push-pull rod means being coupled to the hydraulic drive means for controlling the cycle of operation of the pumping units.

5. In apparatus as defined in claim 4 wherein each of said rod means is coupled to an individual valve element for mechanically operating the valve in accordance with the positions of the rod coupled thereto.

6. In apparatus as defined in claim 4 wherein the pumping units are arranged in parallel alignment and each pumping unit has a piston head mounted in a material cylinder having spaced ends so as to be reciprocated from one end of the cylinder to the opposite end thereof, one end of each cylinder being arranged in communication with the material chamber for receiving the material to be pumped therein and the opposite ends of each cylinder being closed, each of the piston ends defining a closed, variable volume between said closed end and one end of the piston head in accordance with the position of the piston head in the material cylinder, a lubricating fluid medium storage tank mounted between the pumping units so as to be directly coupled in communication with the closed ends of each material cylinder for permitting the stored lubricating medium to flow into and out of said closed volumes behind the piston heads in accordance with their respective positions.

7. In apparatus as defined in claim 6 wherein the lubricating fluid medium comprises water.

8. In apparatus for pumping moist, compressible materials such as plaster, concrete, mortar and the like as defined in claim 4 wherein each of the tips of said blade element are provided with a hard face overlay thereon for the complete extent and tapered for providing shearing edges at said tips.

9. In apparatus for pumping moist, compressible materials such as plaster, concrete, mortar and the like as defined in claim 8 wherein said trunnions have corrosion resistant sleeves secured thereto and extending outwardly from the longitudinal edges of the element a preselected distance.

10. In apparatus for pumping moist, compressible materials, such as plaster, concrete, mortar and the like as defined in claim 9 wherein the sleeves are chromium plated sleeves welded to said trunnions.

* * * * *